US009745169B2

(12) United States Patent
Sonnenmoser

(10) Patent No.: US 9,745,169 B2
(45) Date of Patent: Aug. 29, 2017

(54) SAFETY SYSTEM FOR AN ELEVATOR, ELEVATOR SYSTEM, AND METHOD FOR OPERATING SUCH A SAFETY SYSTEM

(71) Applicant: Inventio AG, Hergiswil (CH)

(72) Inventor: Astrid Sonnenmoser, Hochdorf (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/024,072

(22) PCT Filed: Sep. 22, 2014

(86) PCT No.: PCT/EP2014/070133
§ 371 (c)(1),
(2) Date: Mar. 23, 2016

(87) PCT Pub. No.: WO2015/058918
PCT Pub. Date: Apr. 30, 2015

(65) Prior Publication Data

US 2016/0297641 A1 Oct. 13, 2016

(30) Foreign Application Priority Data

Oct. 23, 2013 (EP) ..... 13189798

(51) Int. Cl.
*B66B 1/34* (2006.01)
*B66B 5/00* (2006.01)
*B66B 1/46* (2006.01)

(52) U.S. Cl.
CPC ..... *B66B 1/3407* (2013.01); *B66B 1/468* (2013.01); *B66B 5/0087* (2013.01);
(Continued)

(58) Field of Classification Search
CPC ... B66B 1/3407; B66B 1/3438; B66B 5/0087; B66B 2201/406; B66B 1/468
See application file for complete search history.

(56) References Cited

U.S. PATENT DOCUMENTS 5,257,176 A * 10/1993 Uetani ..... B66B 1/3407 187/247
5,476,157 A * 12/1995 Todaro ..... B66B 13/24 187/280

(Continued)

FOREIGN PATENT DOCUMENTS

CH EP 0857684 A1 * 8/1998 ..... B66B 5/0087
CH CA 2524772 A1 * 12/2004 ..... B66B 5/0087

(Continued)

OTHER PUBLICATIONS

AIPN Machine Translation, JP 07-206301 A, Nov. 13, 2016, pp. 1-6.*

(Continued)

*Primary Examiner* — William A Rivera
*Assistant Examiner* — Stefan Kruer
(74) *Attorney, Agent, or Firm* — Shumaker, Loop & Kendrick, LLP; William J. Clemens

(57) ABSTRACT

A safety system for an elevator that includes at least one control unit, which control unit is operable in at least two different operating modes. The safety system has at least one electronic lock connected with the control unit, and is connectable, or connected, with at least one electronic key. The control unit is programmed, or programmable, in such that, in the presence of a connection between the electronic key and the electronic lock, it is only operable in one operating mode of a first subset of the operating modes and, in the absence of a connection between the electronic key and the electronic lock, it is only operable in one operating mode of a second subset of the operating modes. A maintenance mode is only available in the second subset of the operating modes.

17 Claims, 1 Drawing Sheet

(52) U.S. Cl.
CPC ..... *B66B 2201/40* (2013.01); *B66B 2201/406* (2013.01); *B66B 2201/4676* (2013.01)

(56) References Cited

U.S. PATENT DOCUMENTS 5,616,894 A * 4/1997 Nieminen ..... B66B 1/34 187/247
5,817,994 A 10/1998 Fried et al.
6,173,814 B1 * 1/2001 Herkel ..... B66B 1/34 187/248
6,230,845 B1 * 5/2001 Yamakawa ..... B66B 11/001 187/314
6,302,240 B1 * 10/2001 Shih ..... B66B 1/461 187/397
6,357,553 B1 * 3/2002 Vialonga ..... B66B 1/468 187/385
7,172,055 B2 * 2/2007 Engel ..... B66B 25/006 187/391
7,318,501 B2 * 1/2008 Felder ..... B66B 1/465 187/414
7,936,249 B2 * 5/2011 Friedli ..... B66B 1/468 340/5.5
8,443,944 B2 * 5/2013 Sonnenmoser ..... B66B 13/22 187/391
8,746,415 B2 * 6/2014 Aluisetti ..... B66B 1/468 187/391
2008/0217114 A1 * 9/2008 Felder ..... B66B 5/021 187/414

FOREIGN PATENT DOCUMENTS

CN 101506079 A 8/2009
FI DE 19800714 A1 * 7/1999 ..... B66B 5/0025
IT EP 2316774 A1 * 5/2011 ..... B66B 5/0087
JP 07206301 A * 8/1995
JP 2004099301 A 4/2004
JP 20100228907 A 10/2010
JP 2011256006 A 12/2011
WO 00/51929 9/2000

OTHER PUBLICATIONS

AIPN Machine Translation, JP 2004-099301 A, Nov. 13, 2016, pp. 1-7.*

* cited by examiner

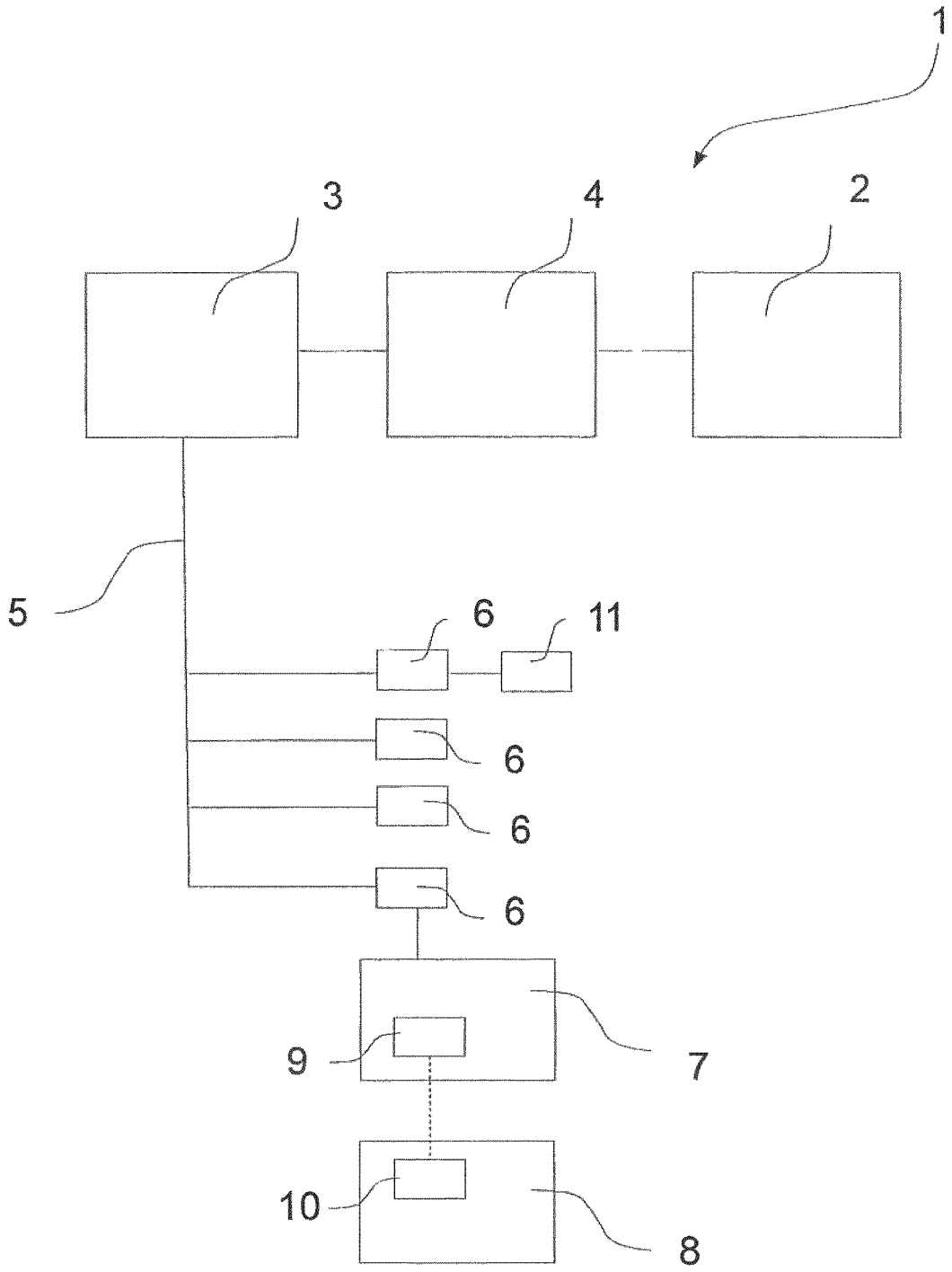
1
3
4
2
5
6
11
6
6
6
9
7
10
8

SAFETY SYSTEM FOR AN ELEVATOR, ELEVATOR SYSTEM, AND METHOD FOR OPERATING SUCH A SAFETY SYSTEM

FIELD

The present invention relates to a safety system for an elevator, an elevator system, and a method for operating such a safety system.

BACKGROUND

Modern elevators have a large number of safety mechanisms with which faults and, in particular, hazardous situations, should be promptly and safely detected and rectified or at least mitigated. For example, they have sensors, with which the position and the velocity of an elevator car are constantly monitored.

A known generic safety system for this purpose is disclosed in WO 00/51929 A1. This safety system has a safety control unit, an elevator control unit for controlling an elevator, and at least one data bus with a plurality of bus nodes, wherein the safety control unit can receive data from the bus nodes through the data bus. The safety control unit can be operated in a plurality of different operating modes, for example in a normal operating mode, a maintenance mode, or an emergency mode. In normal operating mode, for example, on occurrence of a fault signal, a corresponding measure is initiated. For example, upon a predefined critical velocity of the elevator car being exceeded, the safety control unit shall initiate a braking of this elevator car. Alternatively, it is conceivable that, in normal operating mode, the safety control unit interrupts an operation of the elevator with open hoistway doors or car doors, except when the elevator car is exactly at the height of a floor.

If, however, a maintenance service is being performed, in which inter alia the functioning of the sensors should be verified, at least some of the actions that are controlled by the safety control unit and/or the elevator control unit must be disabled. For example, during a maintenance service, an open car door may be desirable, or even required, also in such positions of the elevator car in which it is not situated at the height of a floor. In a maintenance mode, this possibility can be provided.

To enable a maintenance mode, proposed in WO 00/51929 A1 is a maintenance switch, which can be switched on at the beginning of a maintenance service. However, this mechanism is impaired by several limitations. For example, such a maintenance switch can be relatively easily manipulated. Should an unauthorized person have access to this maintenance switch, he can switch the maintenance switch on or off, which, in either case, can endanger not only the maintenance technician.

SUMMARY

It is therefore the task of the present invention to provide a safety system for an elevator which is, inter alia, less easily manipulated—whether by inadvertent interventions of a technician or of an unauthorized person, or through intentional interventions of an unauthorized person. In addition, at least in some embodiments, different subsets of the operating modes should be made available to different groups of persons in simple manner.

In a first aspect, these and other tasks are solved by a safety system for an elevator which contains at least one control unit which can be operated in at least two different operating modes.

According to the invention, the safety system has at least one electronic lock, which is connected with the control unit and is connectable, or connected, with at least one electronic key. Further according to the invention, the control unit is programmed, or programmable, in such manner that

- with existent connection between the electronic key and the electronic lock, it is only operable in an operating mode of a first subset of the operating modes; and,
- with no existent connection between the electronic key and the electronic lock, it is only operable in an operating mode of a second subset of the operating modes, wherein the first subset and the second subset are different from each other. This means that at least one operating mode of the control unit, which is, in principle, available, is contained only in the first subset or only in the second subset. According to the invention, a maintenance mode is only available in the second subset of the operating modes. The control unit is, therefore, only operable in a maintenance mode upon removal of the electronic key from the electronic lock.

In the event that an operating mode is contained only in the first subset, but not also in the second subset, in the presence of the connection between the electronic key and the electronic lock, this operating mode is available. Through an interruption of the connection between the electronic key and the electronic lock, it can be effected that the control unit can no longer be operated in this operating mode. The said operating mode can be, for example, a normal operating mode, which a maintenance technician can enable by connecting the electronic key with the electronic lock. If he interrupts the connection, the normal operating mode is no longer available. Through the use according to the invention of an electronic lock and an electronic key, the safety system is substantially more difficult to manipulate, since, for the enabling of the normal operating mode, a matching electronic key is mandatorily required.

Conversely, in the event that an operating mode is contained only in the second subset, but not also in the first subset, only in the absence of a connection between the electronic key and the electronic lock is this operating mode available. If the connection is restored, the control unit can no longer be operated in this operating mode. The said operating mode can be, for example, a maintenance mode. When the technician performs maintenance work, for example in the elevator hoistway, in order to prevent the elevator car from trapping him it may be necessary to disable the normal operating mode. For this purpose, he can disconnect the electronic key from the electronic lock, which, in this example, is preferably also arranged in the elevator hoistway. If he reestablishes the connection, the normal operating mode is available again. Hence, also in this variant, through use according to the invention of an electronic lock and an electronic key, the risk of a life-endangering faulty manipulation during maintenance work can also be reduced.

The first and/or the second subset can, in each case, contain one or also several of the operating modes of the control unit which are, in principle, available. In particular, it is conceivable that not only does the first subset contain one or more first operating modes which the second subset does not contain, but also that the second subset contains one or more second operating modes, which the first subset does not contain.

The various operating modes can differ from each other in one, several, or all of the following behaviors:

Given the same state of the elevator system, the control unit, in particular an elevator control unit of the control unit, can control the elevator differently in a first operating mode than in a second operating mode. In particular, in a first operating mode, it can transmit a specific control command to the elevator, or to one or more of its components, but in a second operating mode, transmit a different, or no, such control command.

Given the same state of the elevator system, the control unit, in particular an elevator control unit of the control unit, can control the elevator differently in a first operating mode than in a second operating mode.

The aforesaid state of the elevator system can, in particular, contain sensor data from the sensors which are described in detail below.

The operating modes in which the safety control unit is operable can contain at least one operating mode which is selected from the group that consists of at least one normal operating mode, at least one maintenance mode, at least one configuration mode, and at least one installation mode.

In a normal operating mode, for example, the operation of the elevator when the car door is open can be prevented, except when the elevator car is situated at exactly the height of a floor.

In a maintenance mode, one or more contacts can be bridged, and responses of the control unit thereby disabled, which in normal operating mode would be executed. So, for example, door contacts can be bridged, whereby in maintenance mode a movement of the elevator car with open door can be enabled. Alternatively, final-limit switches can be bridged, which, in a normal operating mode, prevent the elevator car from being situated below the lowest floor or above the highest floor, or moving thereto. By bridging these final-limit switches, so-called buffer trips are enabled, in which the lowest and highest physically possible positions of the elevator car can be traveled to, until buffers that are located there are touched. Also alternatively, in a maintenance mode, the travel velocity of the elevator car can be reduced relative to a normal operating mode.

In a configuration mode, for example, the elevator can be reprogrammed. This means that it is, for example, conceivable that, following a height increase of a tall building, travel to additional floors by the elevator must be possible and, for example, additional hoistway doors must be monitored.

The first aforesaid subset of the operating modes, in which the safety control unit is only operable with an existent connection, can only comprise the normal operating mode. Alternatively, also the aforesaid two subsets of the operating modes, in which the safety control unit is only operable with non-existent connection, consist only of the maintenance mode.

The safety system can contain at least one safety control unit, which is operable in the at-least two different operating modes, as well as at least one elevator control unit for controlling the elevator. In this preferred embodiment, the at-least one electronic lock is connected with the safety control unit and the safety control unit is operable depending on the existence or non-existence of the connection between electronic key and electronic lock in the first or second subset of the operating modes.

The term "connection", which is used above and below, includes not only physical connections in which a mechanical contact between electronic key and electronic lock exists. Also included are contact-free connections. In the present case, electronic key and electronic lock should be understood particularly abstractly and functionally.

In a first possible embodiment, the electronic lock comprises at least one RFID reading device and the electronic key contains at least one RFID tag, which can be read out by means of the RFID reader device. Alternatively thereto, the electronic key can contain at least one magnetic stripe, and the electronic lock at least one reader device suitable for reading out the magnetic stripe, with which this magnetic stripe can be read out. Further alternatively, the electronic key can contain at least one optical coding, as, for example, a barcode, and the electronic lock can contain at least one optical reader device for reading out, as, for example, a barcode reader. In another further embodiment, the electronic key can contain at least one chip, and the electronic lock at least one reader device suitable for reading out the chip.

The electronic lock can be arranged in, on, or under the elevator car. It can, for example, be arranged in the vicinity of the control unit or one of its components, as, for example, in a door frame of the elevator car. The electronic lock can also be arranged in the vicinity of, for example, a hand-control which is present on the elevator car. Also alternatively, the electronic lock can be arranged in or on a wall, or a headroom, of an elevator hoistway, or also in a machine room, in particular outside an elevator car.

In advantageous embodiments, the safety system contains at least one data bus with a plurality of bus nodes, wherein the control unit, in particular the safety control unit, can receive data over the data bus from the bus nodes, and the electronic lock is connected with one of the bus nodes.

It is conceivable, and lies within the scope of the invention, that the control unit, in particular the safety control unit, is programmed, or programmable, in such manner that, only after establishment of the connection between electronic key and electronic lock, and time-coordinated execution of at least one further predefined action, is it operable in all operating modes of the first subset of the operating modes. In this case, in addition to creation of the connection between electronic key and electronic lock, a further action must also be executed in order that at least one further operating mode is available.

Similarly, alternatively or additionally, the control unit, in particular the safety control unit, can be programmed, or programmable, in such manner that, only after interruption of the connection between electronic key and electronic lock, and time-coordinated execution of at least one further predefined action, is it operable in all operating modes of the second subset of the operating modes. In this case, in addition to interruption of the connection between electronic key and electronic lock, a further action must also be executed in order that at least one further operating mode is available.

The further predefined action can relate to, for example, the actuation of a reset button or the touching of a touch-sensitive screen. The reset button, or the touch-sensitive screen, is preferably connected with a bus node of one of the aforesaid data buses. In advantageous embodiments, the reset button, or the touch-sensitive screen, is in locational proximity to the electronic lock, in particular at a distance of at most 2 m, preferably at most 1 m.

Under "time-coordinated execution" in this connection is to be understood that, within a predefined maximum time interval, both the connection between electronic key and electronic lock must be established, and also the further predefined action must be executed. The predefined maximum time interval can depend on the arrangement of the components, in particular of the electronic lock, and the dimensions of the elevator system. If, for example, the reset button is in locational proximity to the electronic lock, this time interval can be less than 10 s, preferably less than 5 s. On the other hand, if, in a tall building, the electronic lock is located in a headroom of the elevator hoistway and the reset button on the ground floor, the duration of the time interval can also be up to 5 min, 10 min, or even 15 min.

Alternatively or additionally, the control unit, in particular the safety control unit, can be programmed, or programmable, in such manner that, only after establishment of the connection between the electronic key and the electronic lock, and with time-coordinated execution of a predefined condition, is it operable in the first subset of the operating modes. This predefined condition can be a state of the elevator system that is detected by at least one sensor of the elevator system. For example, the predefined condition can be that a sensor indicates the removal of a balustrade which was temporarily installed on the elevator car during the maintenance. The predefined condition can also be that a sensor detects the removal of a support which was temporarily positioned under a counterweight for the elevator car during the maintenance. In a further variant, the predefined condition can be that at least one bolt was retracted again which, during the maintenance service, was temporarily extended in order to restrict the movement of the elevator car.

Alternatively or additionally, the control unit, in particular the safety control unit, can be programmed, or programmable, in such manner that, only after interruption of the connection between the electronic key and the electronic lock, and with time-coordinated presence of a predefined condition, is it operable in the second subset of the operating modes. This predefined condition can be a specific state of the elevator system which is detected by at least one sensor of the elevator system. For example, the predefined condition can be that a sensor indicates the installation of a balustrade which was temporarily placed in operating position on the elevator car during the maintenance service. The predefined condition can also be that a sensor detects the placement of a support which was temporarily placed under a counterweight for the elevator car during the maintenance. In a further variant, the predefined condition can be that at least one bolt is extended which, during the maintenance, is temporarily brought into operating position, in order to limit the movement of the elevator car.

In some embodiments, the first and/or the second subset of operating modes can only be enabled or disabled through one single electronic key or through a plurality of electronic keys of the same type. A plurality of electronic keys is, in particular, regarded as being of the same type if they bear the same coding. It is, however, also conceivable, and lies within the scope of the invention, that the first and/or the second subset of operating modes are enabled or disabled by a plurality of different types of electronic keys. For example, the electronic keys can bear different codings. With the different types of electronic keys, different subsets of operating modes of the control unit can be enabled or disabled. For example, it is conceivable that with a first electronic key only a normal operating mode can be enabled and that, with a second electronic key, additionally a configuration mode can be enabled. By this means, the configuration mode can only be enabled with the second key. This makes it possible to make different subsets of the operating modes available to different groups of people.

Connected with the control unit can be a sensor, which can transmit sensor data to the control unit, in particular to the safety control unit, in which the sensor data characterize a state of the elevator. The sensor can be directly or indirectly connected with the safety system through the data bus and, in the latter case, the sensor data can be transmitted through the data bus. The sensor can be, for example, a position sensor, a velocity sensor, a final-limit switch for the detection of the highest and lowest permitted positions of the elevator car, a sensor for an aforesaid balustrade, or a sensor for an aforesaid bolt.

A further aspect of the invention relates to an elevator system which contains at least one elevator and at least one safety system as described above.

A further aspect of the invention relates to a method for operating a safety system as described above. This method contains a step in which, at least occasionally, a connection between the electronic key and the electronic lock is established or interrupted. In consequence of the characteristics of the safety system according to the invention, this has the effect that, afterwards, the control unit, in particular the safety control unit, is also no longer operable in at least one additional operating mode and/or in at least one operating mode. Hence, in particular, the connection between electronic key and electronic lock can be established or interrupted in order to enable a normal operating mode or a maintenance mode respectively.

In a second step, the connection between the electronic key and the electronic lock can be established or interrupted again. By this means it can be achieved that, afterwards, the control unit, in particular the safety control unit, again in at least one operating mode is no longer, and/or in at least one operating mode is again, operable, in particular in a maintenance mode or in a normal operating mode.

Optionally, time-coordinated with the first and/or second step, at least one further predefined action can be executed. In particular, a reset button can be actuated or a touch-sensitive screen can be touched.

Under "time-coordinated" as above is to be understood that the interruption or establishment of the connection between electronic key and electronic lock, and the further predefined action, must take place within a predefined time interval.

DESCRIPTION OF THE DRAWINGS

The invention is described in more detail below by reference to a drawing.

FIG. 1 is a block circuit diagram of a safety system for an elevator.

DETAILED DESCRIPTION

FIG. 1 shows a block circuit diagram of a safety system 1 for an elevator 2. The safety system 1 contains a safety control unit 3 for the purpose of monitoring the elevator 2 as well as a data bus 5 with four bus nodes 6. Also provided is an elevator control unit 4 for the purpose of controlling the elevator 2. In particular, by means of the elevator control unit 4, the position and the velocity of a here not-shown elevator car, or the opening and closing of the doors of this elevator car, can be controlled. Through the data bus 5, the safety control unit 3 can receive data from the bus nodes 6. The safety system 1 further has an electronic lock 7, which is connected with one of the bus nodes 6. The electronic lock 7 contains an RFID reading device 9. It is connectable, or connected, with an electronic key 8, which contains an RFID tag 10, which can be read out by means of the RFID reading device 9.

The safety control unit 3 is programmed in such manner that, in the absence of a connection between the electronic key 7 and the electronic lock 8, it is only operable in a maintenance mode. In this maintenance mode, the elevator 2 can be inspected. For example, in this maintenance mode, doors of the elevator car can also be opened, and/or remain open, when the elevator car is not situated at the height of a floor, without an alarm being issued.

Only after re-establishment of the connection between the electronic key 7 and the electronic lock 8, at least one operating mode that deviates from the maintenance mode is available, in particular a normal operating mode. This effectively prevents the activation of the normal operating mode by unauthorized persons who have no access to the electronic key 7.

Connected with one of the bus nodes 6 is a sensor 11, which, through the data bus 5, can transmit sensor data to the safety control unit 3. The sensor data characterize a state of the elevator, for example its position or its speed. For this purpose, the sensor 11 can be embodied as, for example, position sensor or velocity sensor.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A safety system for an elevator that includes a control unit that is operable in at least two different operating modes, comprising:

an electronic lock connected with the control unit; and an electronic key being connectable with the electronic lock, wherein when the electronic key is connected with the electronic lock the control unit only operates in one of the at least two different operating modes of a first subset of the at least two different operating modes, and when the electronic key is not connected with the electronic lock the control unit only operates in another of the at least two different operating modes of a second subset of the at least two different operating modes, and wherein a maintenance mode is only available in the second subset of the at least two different operating modes.

2. The safety system according to claim 1 wherein the control unit is programmed such that, only after establishment of the connection between the electronic key and the electronic lock, and time-coordinated execution of at least one further predefined action, the control unit is operable in the one operating mode of the first subset of the at least two different operating modes.

3. The safety system according to claim 2 wherein the at least one further predefined action is an actuation of a reset button or a touching of a touch-sensitive screen.

4. The safety system according to claim 1 wherein the control unit is programmed such that, only after interruption of the connection between the electronic key and the electronic lock, and a time-coordinated execution of at least one further predefined action, the control unit is operable in the another operating mode of the second subset of the at least two different operating modes.

5. The safety system according to claim 4 wherein the at least one further predefined action is an actuation of a reset button or a touching of a touch-sensitive screen.

6. The safety system according to claim 1 wherein the control unit includes a safety control unit that is operable in the at least two different operating modes, and an elevator control unit connected to the safety control unit for controlling the elevator.

7. The safety system according to claim 1 including a data bus having a plurality of bus nodes, wherein, through the data bus, the control unit receives data from the bus nodes, and the electronic lock is connected with one of the bus nodes.

8. The safety system according to one claim 1 wherein the electronic lock is arranged in, on, or under an elevator car, in or on a wall or a headroom of an elevator hoistway, or in a machine room of the elevator.

9. The safety system according to claim 1 wherein the control unit is programmed such that, only after establishment of the connection between the electronic key and the electronic lock, and with a time-coordinated execution of a predefined action, the control unit is operable in the one of the at least two different operating modes of the first subset of the at least two different operating modes.

10. The safety system according to claim 1 wherein the control unit is programmed such that, only after interruption of the connection between the electronic key and the electronic lock, and with a time-coordinated execution of a predefined condition, the control unit is operable in the another of the at least two different operating modes of the second subset of the at least two different operating modes.

11. The safety system according to claim 1 wherein the at least two different operating modes in which the control unit is operable include at least one operating mode selected from a group consisting of a normal operating mode, the maintenance mode, and a configuration mode.

12. The safety system according to claim 1 wherein the control unit is connected with a sensor that transmits to the control unit sensor data, which sensor data characterizes a state of the elevator, wherein the sensor is one of a position sensor, a velocity sensor, a final-limit switch for detection of a highest permitted position of an elevator car of the elevator, a final-limit switch for detection of a lowest permitted position of the elevator car of the elevator, a balustrade sensor which is temporarily installed during a maintenance service, and a sensor for a bolt which is temporarily installed during a maintenance service for restricting movement of the elevator car.

13. A method for operating a safety system for an elevator comprising the steps of:

providing a control unit for operating the elevator in at least two different operating modes;

connecting an electronic lock with the control unit;

providing an electronic key being connectable with the electronic lock, wherein when the electronic key is connected with the electronic lock the control unit only operates the elevator in one of the at least two different operating modes of a first subset of the at least two different operating modes, and when the electronic key is not connected with the electronic lock the control unit only operates the elevator in another of the at least two different operating modes of a second subset of the at least two different operating modes, and wherein a maintenance mode is only available in the second subset of the at least two different operating modes; and performing a first connection step establishing or interrupting the connection between the electronic key and the electronic lock.

14. The method according to claim 13 including a second connection step of establishing again or interrupting again the connection between the electronic key and the electronic lock.

15. The method according to claim 14 including, time-coordinated with the first connection step or the second connection step, executing at least one predefined action.

16. The method according to claim 15 wherein the at least one predefined action is actuating a reset button or touching a touch-sensitive screen.

17. An elevator system including an elevator and a safety system, the safety system comprising:

a control unit for operating the elevator in at least two different operating modes;

an electronic lock connected with the control unit; and an electronic key being connectable with the electronic lock, wherein when the electronic key is connected with the electronic lock the control unit only operates the elevator in one of the at least two different operating modes of a first subset of the at least two different operating modes, and when the electronic key is not connected with the electronic lock the control unit only operates the elevator in another of the at least two different operating modes of a second subset of the at least two different operating modes, and wherein a maintenance mode is only available in the second subset of the at least two different operating modes.

* * * * *